US005485347A

United States Patent [19]

Miura

[11] Patent Number: 5,485,347

[45] Date of Patent: Jan. 16, 1996

[54] RIDING SITUATION GUIDING MANAGEMENT SYSTEM

[75] Inventor: Okimi Miura, Sagamihara, Japan

[73] Assignee: Matsushita Electric Industrial Co., Ltd., Osaka, Japan

[21] Appl. No.: 260,984

[22] Filed: Jun. 15, 1994

[30] Foreign Application Priority Data

Jun. 28, 1993 [JP] Japan ..... 5-156678

[51] Int. Cl.[6] ..... B61B 1/00; E01F 1/00; G06M 7/00; G06M 9/00

[52] U.S. Cl. ..... 364/557; 364/559; 364/561; 364/565; 364/569; 104/28; 377/6; 377/25

[58] Field of Search ..... 104/28, 30, 31; 235/33; 364/400, 403, 407, 557, 559, 561, 565, 569; 377/6, 25; 340/944; 105/329.1, 341, 341.5

[56] References Cited

U.S. PATENT DOCUMENTS 4,009,389 2/1977 Lindholm ..... 250/221
4,528,679 7/1985 Shahbaz et al. ..... 377/6
4,685,135 8/1987 Lin et al. ..... 395/2.69
4,692,941 9/1987 Jacks et al. ..... 395/2.69
5,068,537 11/1991 Ishikawa et al. ..... 250/342
5,176,082 1/1993 Chun et al. ..... 104/28

FOREIGN PATENT DOCUMENTS 2296573 12/1990 Japan .

*Primary Examiner*—Ellis B. Ramirez
*Assistant Examiner*—Stephen R. Tkacs
*Attorney, Agent, or Firm*—Stevens, Davis, Miller & Mosher

[57] ABSTRACT

A riding situation guiding management system includes, in each of plural cars constituting a train, an up/down counter for counting passengers getting on and off each car with passenger sensor/counter units provided at doorways and passways of the cars, and a transmission unit arranged in the train for transmitting the passenger information to forward stations, and a broadcasting unit provided in each station for receiving and analyzing the information as well as for broadcasting speech indicative of a current riding situation for each car of the train to passengers who are waiting for the train.

14 Claims, 13 Drawing Sheets

(FIRST CAR)
(SECOND CAR)
(THIRD CAR)
(FOURTH CAR)
RECORDER
(DATA COLLECTION, TOTALIZATION, RECORDING)
PASSENGER SENSOR/COUNTER UNIT
TRAFFIC INFORMATION CENTER
READER
LARGE CAPACITY STORAGE UNIT
PRINTER
DATA CONTROLLER
DISPLAY UNIT
COMMUNI-CATION UNIT
1
2
3
4
11
12
13
14
15
21
22
23
24
25
27
31
32
33
34
35
41
42
280
282
283
284
285
286
287

TOP VIEW

PATTERN DIAGRAMS WHEN ONE PASSENGER IS PASSING

TOP VIEW

RIDING SITUATION GUIDING MANAGEMENT SYSTEM

BACKGROUND OF THE INVENTION

The present invention relates to a riding situation guiding management system for detecting the number of passengers and a crowdedness degree for transportation means such as Shinkansen trains, passenger trains, route buses, or the like, and for conducting management in order to provide such information to passengers in advance.

When the timetable or train diagram is to be revised for the Shinkansen, passenger trains, route buses, or the like, investigation on traffic amount, such as measurements of the number of passengers and a crowdedness degree in cars, is made for the purpose of relieving extremely crowded cars, planning economical assignment of cars, and so on. For this investigation on traffic amount, much greater number of persons as before are employed to manually count the number of passengers at desired locations and totalize the thus collected data.

There is also a case of a transportation system, where the number of passengers is counted at each of a separately provided exclusive entrance and exit at each bus stop for route buses, and data on the number of passengers are collected and analyzed such that the data is utilized for revising the timetable of the route buses.

However, the above-mentioned conventional investigation based on the counting of the number of passengers requires a great number of persons and much time, because a measurer must be located at each of the desired locations for counting passengers in a so-called human sea tactics manner. In addition, since the collection and analysis of the measured data require several days, the data cannot be put to practical use immediately. Nevertheless, a riding situation in any car of any train or in any bus is always changing from one minute to the next, and passengers generally desire to select an appropriate train in accordance with such changes so as to travel to a destination as comfortably and rapidly as possible.

For example, assuming that a person takes "Hikari-go" of the Tokaido Shinkansen from Shinyokohama Station to Shinosaka Station for a business trip, if he cannot have a seat in a car he has got on, he must walk along cars for a vacant seat or he must be kept standing all the way for a long time, at least until the train arrives at Nagoya Station, which is the next stop in this case, where some passengers, who have been seated, may get off the train. Another case shows that even if several cars are extremely crowded with passengers, vacant seats may be found in the leading car of the same train. It can be said in this case that the train is transporting in an inefficient manner.

As is apparent also from the above-mentioned cases, the number of passengers and riding situations in cars of the Shinkansen, passenger trains, and so on as well as in route buses, cannot be revealed from a minute to the next to give such information to passengers waiting for a train or a bus in forward stations or bus stops, so that services for offering comfortable travel cannot be prepared for the passengers.

SUMMARY OF THE INVENTION

The present invention has been made to solve the problems as described above inherent to the conventional transportation systems, and its object is to provide a riding situation guiding management system which measures the number of passengers in each of the cars, communicates the measured number of passengers to forward stations, and gives such information to passengers waiting in the forward stations, thus providing improved services to the passengers.

To achieve the above object, the present invention provides a passenger sensor/counter unit arranged at a doorway of a car or a passageway to an interconnection to the next car for counting passengers passing therethrough in order to detect the number of passengers in each car. A transmission means is provided for transmitting this information to forward stations. Each of the forward stations is provided with a means for receiving, analyzing, and recording the information as well as for informing the number of passengers and a riding situation in each car of subsequently arriving trains, thus giving such information to passengers in advance.

The passenger sensor/counter unit of the present invention, arranged at a doorway or a passageway of a car as mentioned above, comprises means for counting passengers passing through a measuring place by means of ultra-high frequency waves, and means for determining whether a passenger is getting on or off a car or whether a passenger is coming into or going out of a car. Thus, the number of passengers in each car is constantly increased and decreased to reveal the number of passengers in each car at any time on any day.

Thus, according to the present invention, the number of passengers in each car of a train is transmitted to forward stations, such that a riding situation and a crowdedness degree of each car are displayed in the forward stations. With this information, passengers waiting in forward stations for a train can determine which car to take in order to have a comfortable travel.

Further, by installing the passenger sensor/counter unit according to the present invention at a doorway or a passageway of a car, the number of passengers passing through a measuring place is sensed, for example, by an ultra-high frequency sensor, and a pair of photo sensors are used to determine whether passing passengers are coming into or going out of the car. The number of passengers is increased and decreased by an up/down counter in accordance with the determination result of the photo sensors to allow the ever-changing number of passengers currently staying in each car to be correctly counted, thus readily collecting effective data useful for improving services for passengers, revising the train diagram, and so on.

DESCRIPTION OF THE PREFERRED EMBODIMENTS

Figure 1:
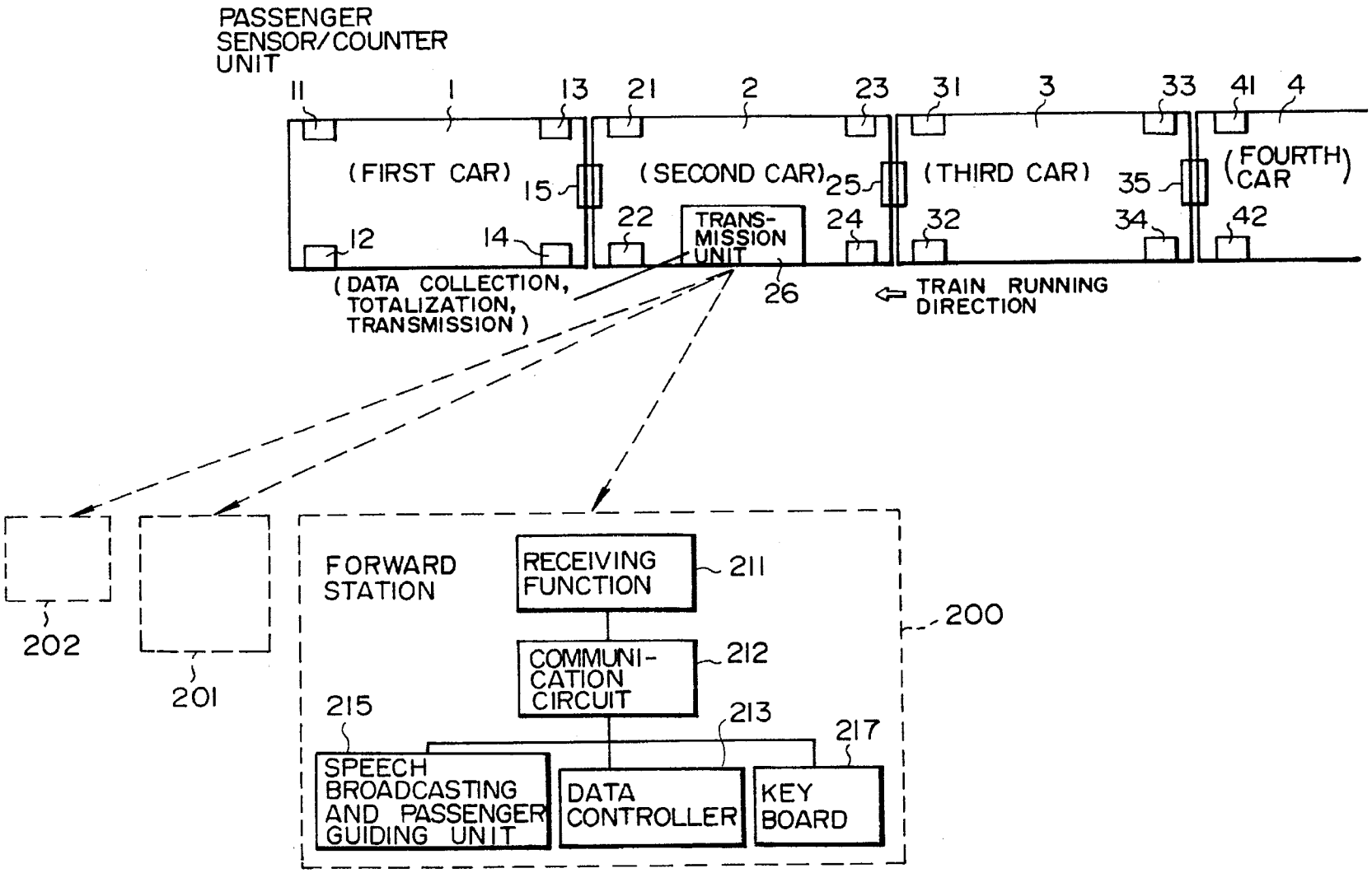
FIG. 1 shows a riding situation guiding management system according to a first embodiment of the present invention.

FIG. 1 shows the configuration of a first embodiment of the present invention. A riding situation guiding management system according to the first embodiment broadcasts speech indicating information on a transportation situation of cars, i.e., the number of passengers in each car for passengers waiting in forward stations or the like, such that the passengers can be guided at any time.

In FIG. 1, reference numerals 1–4 . . . , designate a plurality of cars joined together to form a train of the Shinkansen or the like; 11–14, 21–24, 31–34, 41–42 passenger sensor/counter units each arranged at a doorway of the cars; 15, 25, 35 passenger sensor/counter units each arranged at a passageway to an interconnection between two cars; 26 a transmission unit having functions of collecting and totalizing information on the number of passengers from each of the sensor/counter units and transmitting the information to forward stations at which the train is scheduled to stop.

Assume, for example, that "Hikari-go" of the Shinkansen, which stops only at Shinyokohama Station, Nagoya Station, and Shinosaka Station, has left Tokyo station and is running toward the Shinyokohama Station. Assume also that in Tokyo Station, passengers orderly enter first–fifth unreserved-seat cars from respective doorways, and some passengers go out of the cars for buying something at kiosks and return to the cars through the doorways before the departure of the train. The number of passengers passing through doorways is measured by the sensor/counter units arranged at doorways of the respective cars for counting passengers. Passengers getting on the car are counted in the increasing direction, while those getting off the car are counted in the decreasing direction. Further, each of the sensor/counter units arranged at passageway to interconnections of cars counts passengers entering the car in the increasing direction and those going out of the car in the decreasing direction. Therefore, the number of passengers currently staying in each car is the sum of the counted values registered in all the sensor/counter units arranged at the doorways and the passageway of the car. In this manner, passengers who have moved from one car to another after the departure can also be counted.

Data on the number of passengers such as the number of passengers in each car, the number of passengers passing through each of the doorways and passageway are collected and transmitted to a receiver 211 in the next station 200 by the transmission unit 26 arranged in the train. Reference numeral 201 designates the second station from the starting station; and 202 the third station from same. In each of these stations 201, 202, the data on the number of passengers from the transmission unit 26 are received by a receiver 211 and converted by a communication circuit 212 to audible data which is clearly broadcasted by a speech broadcasting and passenger guiding unit 215 for guiding passengers waiting in the station, under the control of a data control unit 213.

The speech broadcasting and passenger guiding unit 215 is controlled by the data control unit 213, and may be incorporated in a broadcasting system which automatically guides passengers by a synthetic voice generator.

Description will be next made as to effects produced by the riding situation guiding management system of the first embodiment configured as described above.

Passengers waiting for the "Hikari-go" in Shinyokohama Station for going to Shinosaka Station generally desire to have a seat in a car so as to have a comfortable trip. If they could not find a vacant seat when they get on the train at Shin-yokohama Station, they would have to be kept standing at least till Nagoya Station. To help these passengers, the speech broadcasting and passenger guiding unit 215 broadcasts in Shinyokohama station a riding ratio and a crowdedness degree of each car of the next train, thus allowing passengers, who are waiting for the train, to follow one of the lines to cars in which they are aware from the information that vacant seats are available. If the passengers are informed that no vacant seat is available in the next train, but many vacant seats are found in the next but one train, they may select the next but one train in order to be seated until Shinosaka Station in comfort even though they arrive at Shin-osaka Station a bit later, provided that they have enough time.

Another case shows that even if a train partially includes extremely crowded cars, vacant seats may be found in other cars of the same train. If many passengers are going to get on a car of a train from a particular doorway, an efficient transportation is hindered. Moreover, since this causes the train to stop at the station for a longer time, the train will be delayed from the train diagram, and there is even a fear of an accident possibly occurring while passengers are getting on and off the train.

In such cases, the management system of this embodiment can effectively lead or guide passengers to less crowded cars, so that passengers are evenly distributed to several cars, resulting in improving the transportation efficiency of passengers. In this manner, passengers are provided with a guiding service for having a comfortable trip, i.e., for preventing concentration of passengers in crowded cars and realizing safe getting on and off and reduction of time required to the passengers' getting on and off.

Figure 2:
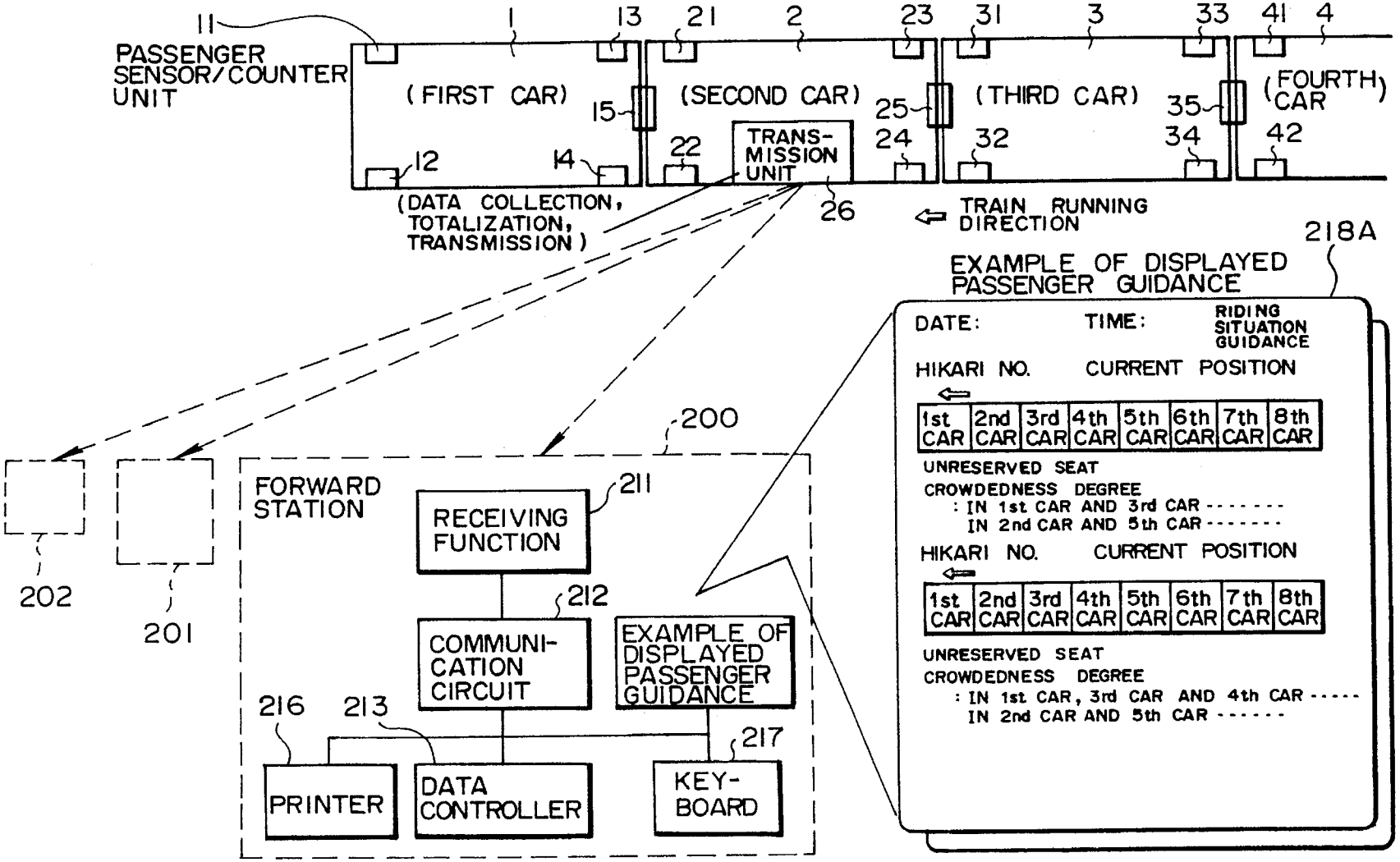
FIG. 2 shows a riding situation guiding management system according to a second embodiment of the present invention.

FIG. 2 shows the configuration of a second embodiment of the present invention. A riding situation guiding management system according to the second embodiment includes a display means for displaying a situation of a next train, such as the number of passengers in cars constituting the next train, in order to provide guidance to passengers waiting for a train in forward stations. In this manner, passengers can be always guided with visual information on the train.

Components in FIG. 2 identical to those in FIG. 1 are designated the same reference numerals, and explanation thereof with respect to the configuration thereof will be omitted, and instead aspects different from FIG. 1 will be described in principle.

The second embodiment features that a printer 216 and a display unit 218 are newly provided in the management system. When a passenger waiting in a forward station inputs from a keyboard 217 the identification number of a train which the passenger wants to get on, the display unit 218 displays on its screen information on the number of passengers in each car of the train, while the printer unit 216 provides the passenger with a printed version of the information.

As illustrated in an example of a display 218A of passenger guidance, the screen of the display unit 218 visually provides the classification of each car (unreserved seat car, green (higher grade seat) car, reserved normal seat car), and the presence or absence of vacant seats, number of vacant seats if available, riding ratio, and crowdedness degree corresponding to each car or each doorway. The above information should be displayed so as to express in readily understandable sentences. Specifically, the number of vacant seats should express the difference between the number of available seats and the number of passengers currently in a car; the riding ratio should express a ratio of a current number of passengers in the car to the passenger capacity of the car; and the crowdedness degree should express how crowded the car is with passengers, respectively. The sentences for this information should express the difference in situation in a clearly understandable manner so as to allow passengers to distinctively imagine the situation of the train. For example, the expressions may be "although there is no vacant seat available, you can read a newspaper", "although there is no vacant seat available, the crowdedness degree is such that you can read a book", "you cannot walk in the car", and so on.

Alternatively, as another example of display, the above-mentioned passenger information may be displayed in the form of illustrations on the screen of the display unit 218. For example, inputting the identification number of a desired train through the keyboard 217 or the like, a passenger will be given a display of the passenger information for each car of the train. More specifically, the presence or absence of vacant seats, the number of vacant seats if available, crowdedness degree, and so on are displayed in different colors, different contracts, different patterns, or cutting illustrations, in accordance with situations. This allows passengers to readily identify and understand a current situation in a desired train.

In this manner, according to the second embodiment, in addition to the ability of leading passengers waiting in stations to previously recognize information on a train which they desire to get on, similarly to the first embodiment, such information is displayed on the screen of the display unit 218 in order to allow passengers to readily and visually determine which car to select, while they are impatient before getting on a train, thus providing further facilities for passengers.

It is also possible to print desired passenger information by the printer 216 and distribute the printed outputs to passengers.

Figure 3:
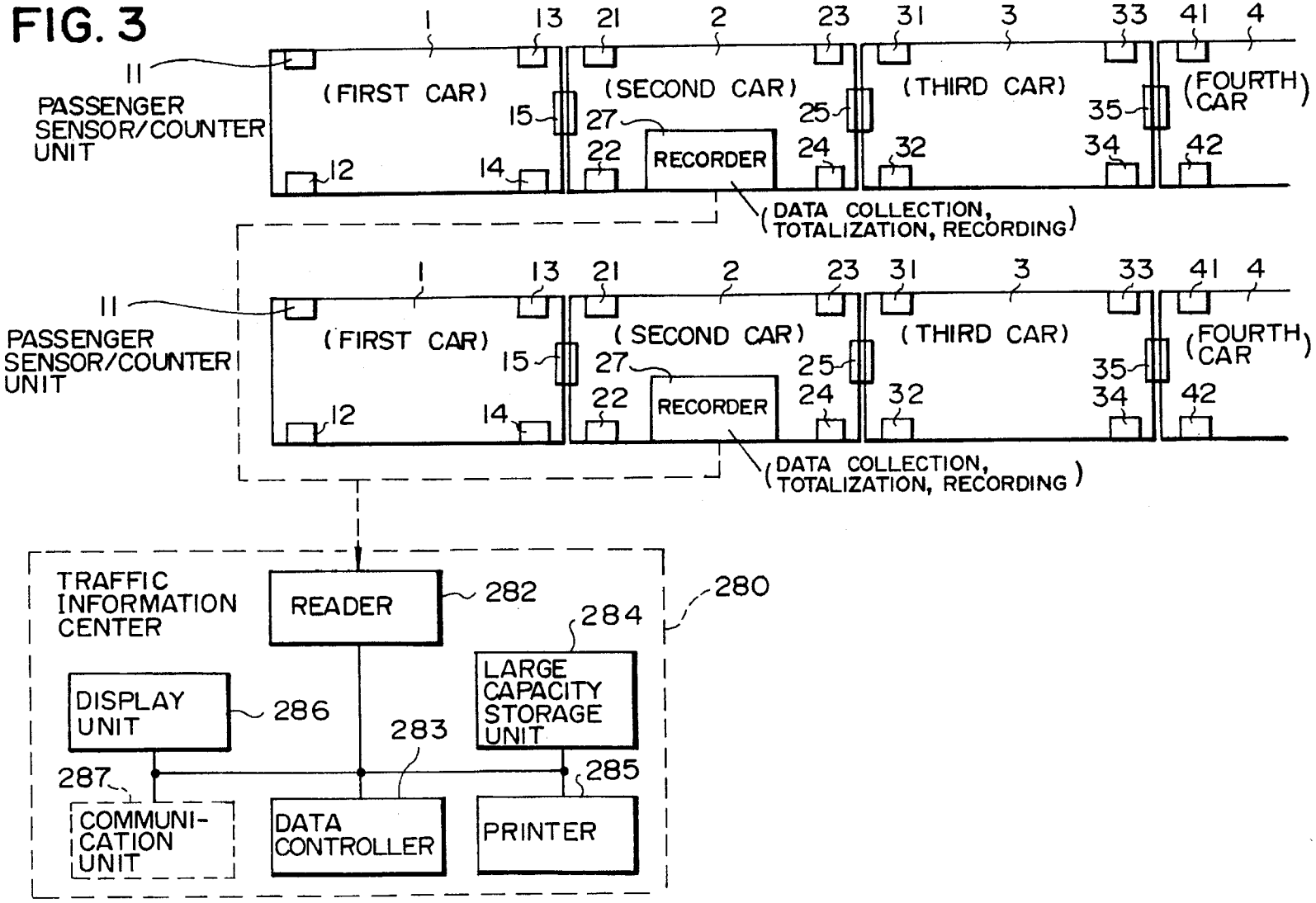
FIG. 3 shows a riding management system according to a third embodiment of the present invention.

FIG. 3 shows the configuration of a third embodiment. A riding management system according to the third embodiment includes a function of counting the number of passengers in each car at every hour by means of a passenger counter; a function of recording this passenger count information; and a function of statistically analyzing the passenger count information for each car, so as to make good use of this information when revising or creating train diagrams or timetables.

In FIG. 3, cars 1–4 constituting a train are provided at respective doorways thereof with passenger sensor/counter units 11–14; 21–24; 31–34; 41–42, and passenger sensor/counter units also near respective passageway to interconnections between two cars, as is the case of FIG. 1. Further, the train is newly provided with a recorder 27 for collecting passenger data such as the number of passengers in each car, the number of passengers passing through each of the doorways and passageway, and totalizing and recording the collected data.

A traffic information center or the like for creating and revising the train diagram, as indicated by 280 in the drawing, can read passenger data from the recorder 27 by a reader 282, store the data in a large capacity storage unit 284 in the form of files, print documents by a printer 285, and display the data on the screen of a display unit 286, based on control and analysis executed by a data controller 283. A suitable means for the recorder 27 arranged in the train may be a floppy disk drive, IC card unit, magnetic card unit, or the like, data of which can be read by the reader 282 and transferred to the large capacity storage unit 284.

From a large amount of the collected numerical value data, the data controller 283 selects necessary items, and statistically processes the selected items in order to adapt the data to calculations for a mean value, maximum value, minimum value deviation, changing point, particular point, fare adjustments, information processing such as ranking, simulation, and histogram, reference, search, and management.

A train diagram created or revised on the basis of the thus analyzed and processed data may be printed on paper by a printer 285 or displayed on the screen of the display unit 286.

Thus, a large amount of data such as the number of passengers at every hour, the riding ratio, the number of passengers getting on and off at each station, and so on can be recorded in order to accumulate data on each train. The data may be analyzed and utilized at maximum, when creating or revising a train diagram, to plan assignment of trains and time setting in consideration of the relieving of extremely crowded trains and economical efficiency.

The riding situation guiding management system realized by the present invention can therefore collect a much larger amount of data and accumulate highly accurate data which may be analyzed from any factor, as compared with the conventional traffic investigation which requires a large number of persons and must be performed in human sea tactics manner. Further, in comparison with a conventional data collection method for traffic investigation, which relies on manual operations, data collection with the storage unit 284 requires less cost, time, and personnel, so that the conventional manually operated traffic investigation can be rendered unnecessary.

In addition to the operations of the system described above, for a reading operation executed in the traffic information center 280 or the like to read recording media on which data information on each train and each car are recorded by the recorder 27 arranged in the train, the reader 282 may be a collective reader which can parallelly read a large amount of recording media.

As described above, the third embodiment realizes a riding management system which is characterized by counting means arranged in a train for counting the number of passengers in each of the cars constituting a train by means of passenger sensor/counter units; means arranged in the train for transmitting the information to forward stations;

means for recording and storing the information; and means for statistically analyzing passenger data information on each car at every hour. This system can be effectively utilized when a train diagram is created and managed.

A large amount of accumulated data, such as the number of passengers getting on a train through each doorway at every hour, the riding ratio, the number of passengers getting on and off at each station, and so on may be utilized for assignment of seasonal special trains, reassignment of trains in accordance with amounts of passengers getting on and off, development of work plans such as extension of platforms, rearrangement of platform wickets, and so on.

While in the configuration of the above embodiment, the recorder 27 arranged in a train collects, totalizes and records data information for the respective cars, and recording media, on which the data information is recorded by the recorder 27, are read by the reader 282 in the traffic information center 280 or the like where the train diagram is created and revised, it should be noted that the present invention also includes a system which comprises a recorder 27 having a transmission function for transmitting the collected data which is received by a communication unit 287 at any time and transferred to the large capacity storage unit 284 for filing the data. The transmission function may be implemented by, for example, a communication method for transmitting a variety of modulated waves through radio communications and wire communications.

Figure 4A:
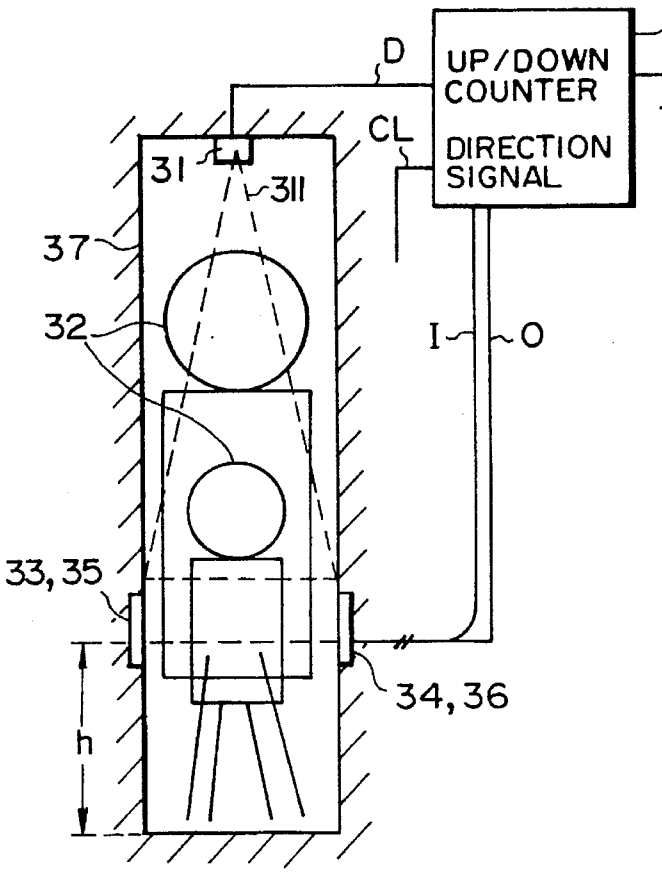
FIG. 4A–4C shows a passenger sensor/counter unit in the management system of the present invention.
Figure 4B:
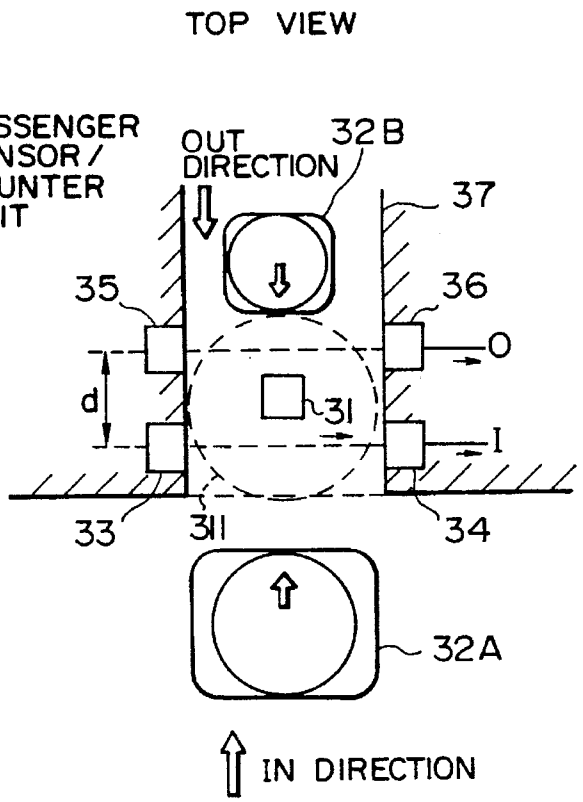
Figure 4C:
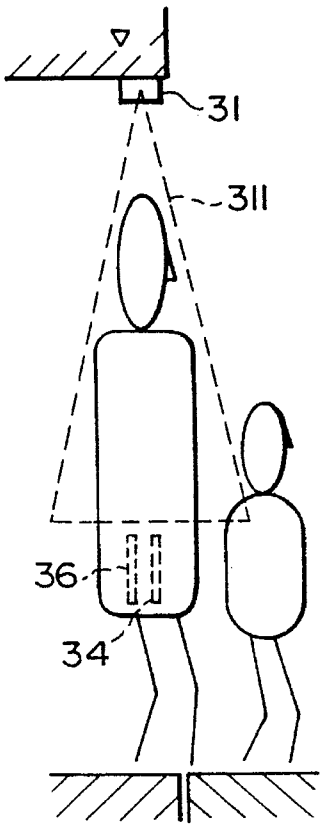
Figure 5:
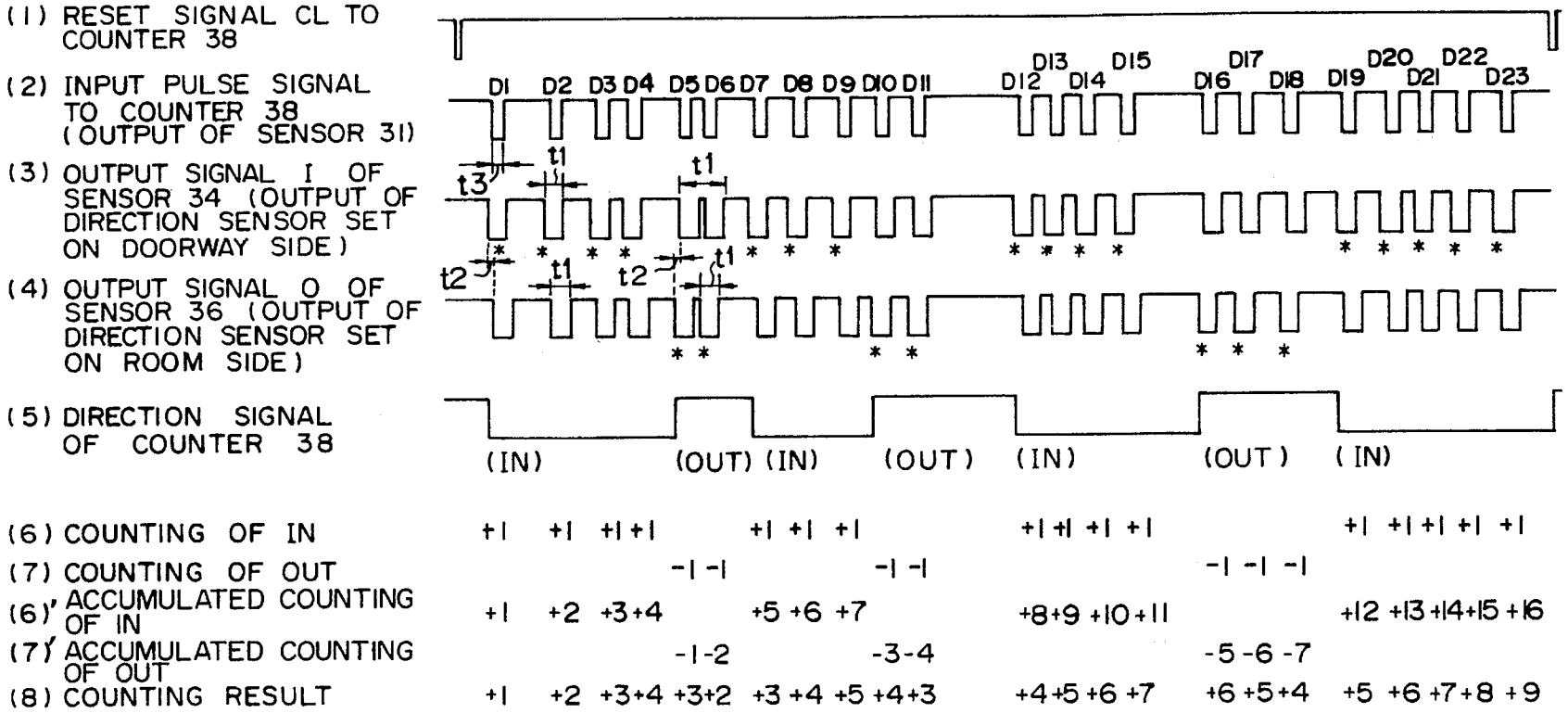
FIG. 5 is an increment value selection table for explaining the operation of the sensor/counter unit shown in FIGS. 4A–4C.

FIGS. 4A, 4B, 4C show the configuration of the passenger sensor/counter unit used in the first, second and third embodiments. FIG. 4A shows a front view of a measuring place adjacent a doorway of a car; FIG. 4B a top view of the measuring place adjacent the doorway; and FIG. 4C a side view of the measuring place adjacent the doorway. FIG. 5 is a timing chart for explaining the operation of the passenger sensor/counter unit.

The sensor/counter unit shown in FIGS. 4A–4C is suitable for counting the number of passengers getting on and off a car through a narrow doorway, such as that of the Shinkansen, through which two or more persons cannot pass in parallel.

Specifically referring to FIGS. 4A–4C, reference numeral 31 designates a differential type ultra-high frequency sensor for sensing a change in a reflection time of light emitted therefrom, caused by a passenger 32 passing through the passenger measuring place and interrupting a light receiving range 311, to generate a pulse signal. Reference numerals 34, 36 designate a pair of photo sensors which serve as a direction sensor for determining whether a passenger is getting on or off the car. Reference numeral 38 designates an up/down counter for counting the number of passengers passing through the measuring place.

Two pairs of LED 33, 35 for emitting light on both sides of the doorway 37 and photo sensors 34, 36 for receiving the light are parallelly arranged at a height h across which a passenger 32 passes through the doorway. Appropriately, these LEDs 33, 35 and photo sensors 34, 36 are placed at parallelly opposing positions at the height h which should range approximately from 60 cm to 110 cm from the floor in order to recognize children as well as adults. The two LEDs 33, 35 are placed opposite to the photo sensors 34, 36 such that light rays emitted from the LEDs 33, 35 are parallelly received by the photo sensors 34, 36 with a spacing d. The pairs are also isolated so as not to interfere with each other.

The operation of the sensor/counter unit shown in FIGS. 4A–4C will be next explained. Before starting to count the number of passengers getting on and off a car, an accumulated count value in the up/down counter 38 is reset to zero by a clear reset signal CL. As a passenger 32 passes through the passenger measuring place 37 such as a narrow doorway, this passenger 32 interrupts the ultra-high frequency wave to cause a change in the reflection time thereof which is sensed by the ultra-high frequency sensor 31. The ultra-high frequency sensor 31 responsively generates a differential type pulse signal D to a data input D of the up/down counter 38. The up/down counter 38, in response to the pulse signal D inputted thereto, recognizes that one passenger 32 has passed through the doorway and counts up by "+1". In this manner, the number of passengers passing through the doorway is measured. As shown in FIG. 4B, the direction sensor is composed of the two pairs of LEDs and photo sensors, i.e., the doorway side set 33, 34 and the room side set 35, 36 equally spaced by the distance d, which operate in the following manner. When a passenger 32A gets on a car through a doorway, the direction sensor set 33, 34 on the doorway side senses the passenger 32A to cause the sensor 34 to generate a pulse signal I ((3) of FIG. 5) with a pulse width equal to a constant time t1. Subsequently, the direction sensor set 35, 36 on the room side senses the passenger 32A to cause the sensor 36 to generate a pulse signal O ((4) of FIG. 5) with a pulse width equal to the constant time t1. The pulse signals I, O from the direction sensors 34, 36 are supplied to inputs I, O of the up/down counter 38, respectively. If the pulse signal I is inputted to the up/down counter 38 prior to the pulse signal O, the counter 38 determines that a direction signal ((5) of FIG. 5) indicates that a passenger has got on the car (IN), so that the counter 38 can count a passenger getting on the car. In the opposite case, the direction signal is determined to indicate that a passenger is getting off the car (OUT). Thus, the counter 38 can also count the number of passengers getting off the car.

Conversely, when a passenger 32B, who is getting off the car, passes through the doorway, the direction sensor set 35, 36 on the room side senses the passenger 32B to cause the sensor 36 to generate the pulse signal O ((4) of FIG. 5) with the pulse width equal to the constant time t1. Subsequently, the direction sensor set 33, 34 on the doorway side senses the passenger 32B to cause the sensor 34 to generate the pulse signal I ((3) of FIG. 5). Thus, the pulse signals I, O are generated in the order reverse to the above, whereby the up/down counter 38 determines that the direction signal ((5) of FIG. 5) indicates OUT and can count a passenger getting off the car.

In this manner, the up/down counter 38 can accumulatively count the number of passengers getting on the car ((6) of FIG. 5), the number of passengers getting off the car ((7) of FIG. 5), and the difference therebetween ((8) of FIG. 5).

It should be noted that a time tp allowed to determine which of the two pulse signals I, O is generated earlier should be equal to or shorter than a difference t2 between the pulse signals I, O inputted to the up/down counter 38. This time tp corresponds to about 15 nanoseconds (ns) when the up/down counter 38 is implemented by a semiconductor device. The input time difference t2 between the two pulse signals I, O is represented by the ratio of the distance d between the light rays emitted from the LEDs 33, 35 to a speed v at which passengers pass through the direction sensors. With the distance being set to 10 cm, the passengers' passing speed should be 83 cm/second, and the time difference t2 120 milliseconds (ms). It is understood that tp is sufficiently smaller than t2 and an negligible value.

Even if an approaching passenger passes through the measuring place, the ultra-high frequency sensor 31 senses the passenger to generate the differential type pulse signal D (pulse width t3=200 ms). Since the pulse signals I, O generated by the direction sensors have the pulse width of the constant time (t1=500 ms), which is different from that of the pulse signal D, these signals D, I, O can be precisely discriminated, so that passengers can be correctly counted.

As is apparent from the above description, the passenger sensor/counter unit can realize correct counting of passengers getting on and off a car through a narrow doorway such as that of the train of the Shinkansen which does not allow two or more passengers to pass therethrough in parallel.

Figure 6B:
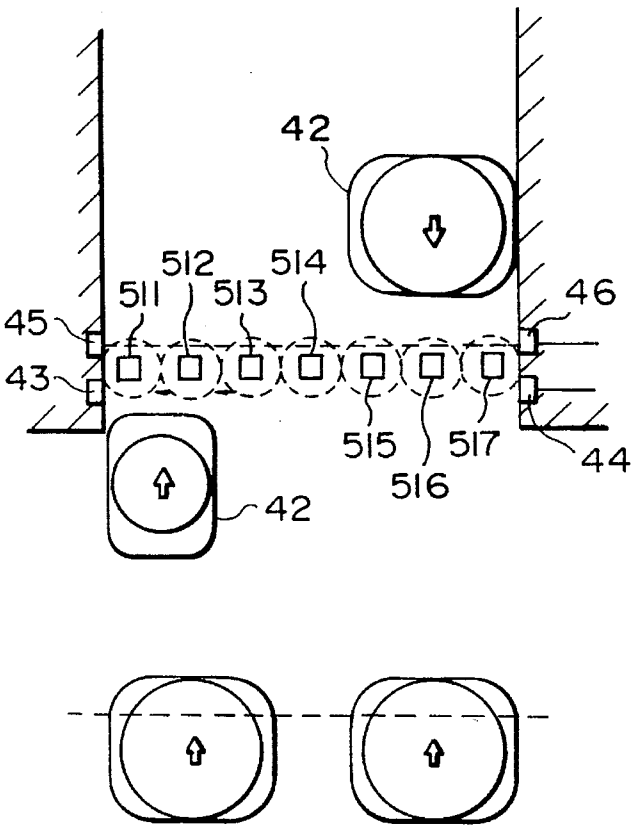
FIGS. 6A and 6B show another example of the passenger sensor/counter unit in the management system of the present invention.
Figure 6A:
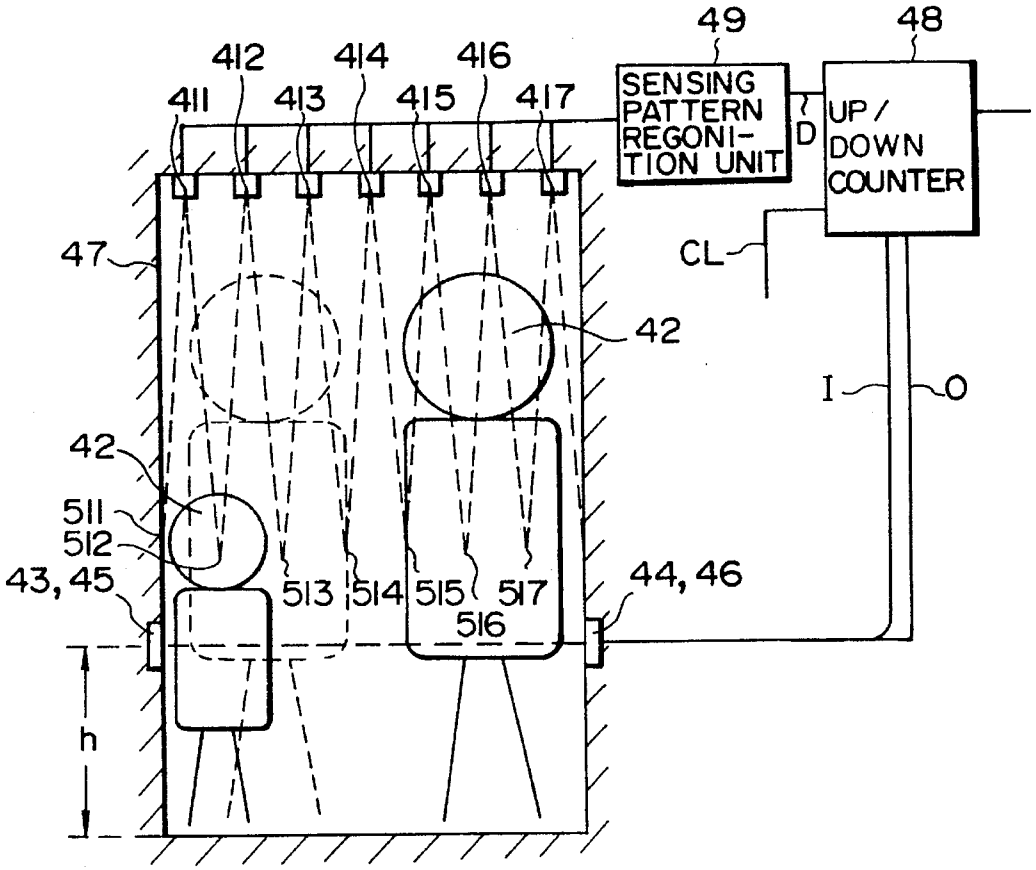
Figure 7:
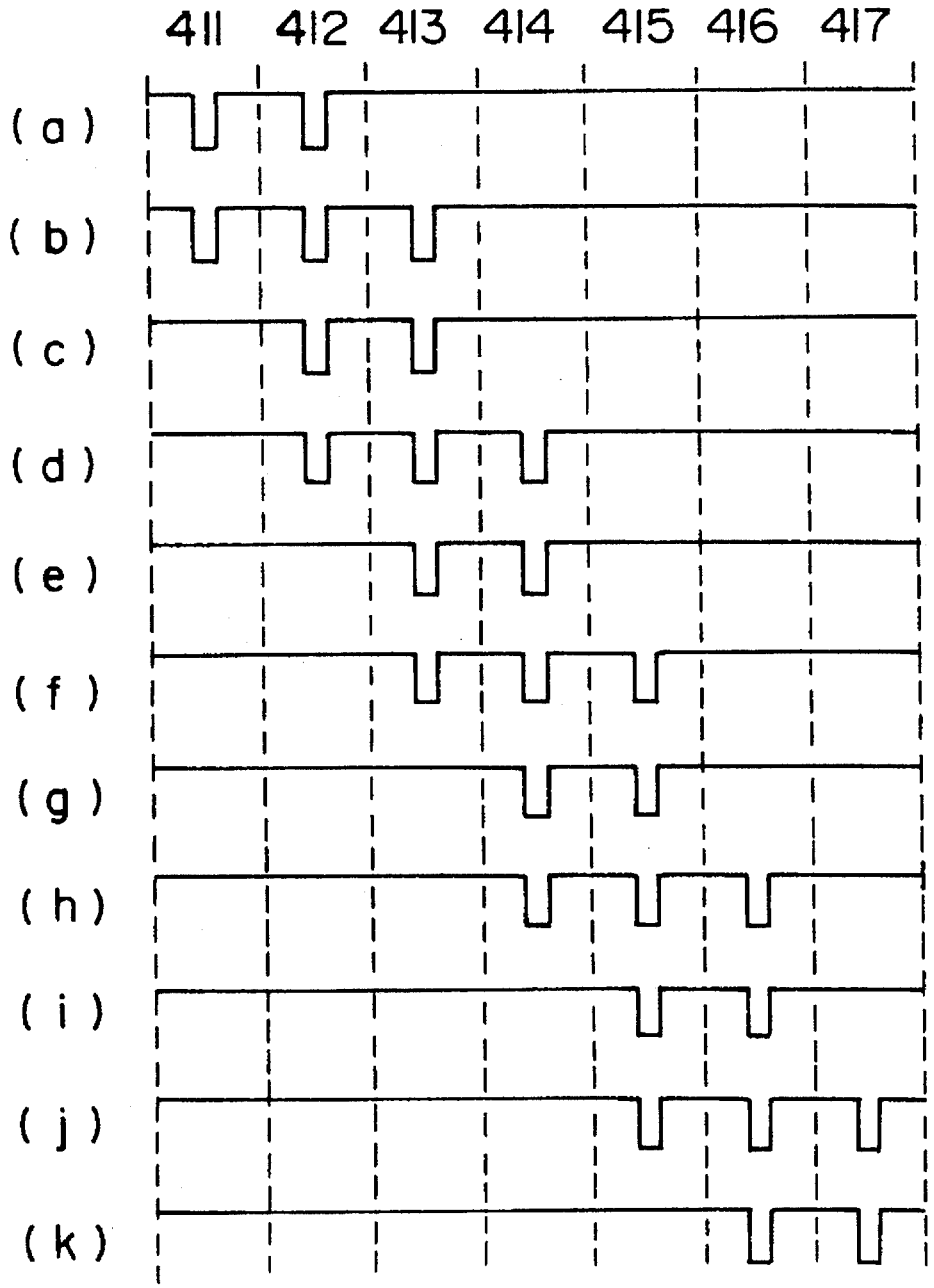
FIG. 7 is an increment value selection table for explaining the operation of the sensor/counter unit shown in FIGS. 6A and 6B.
Figure 8:
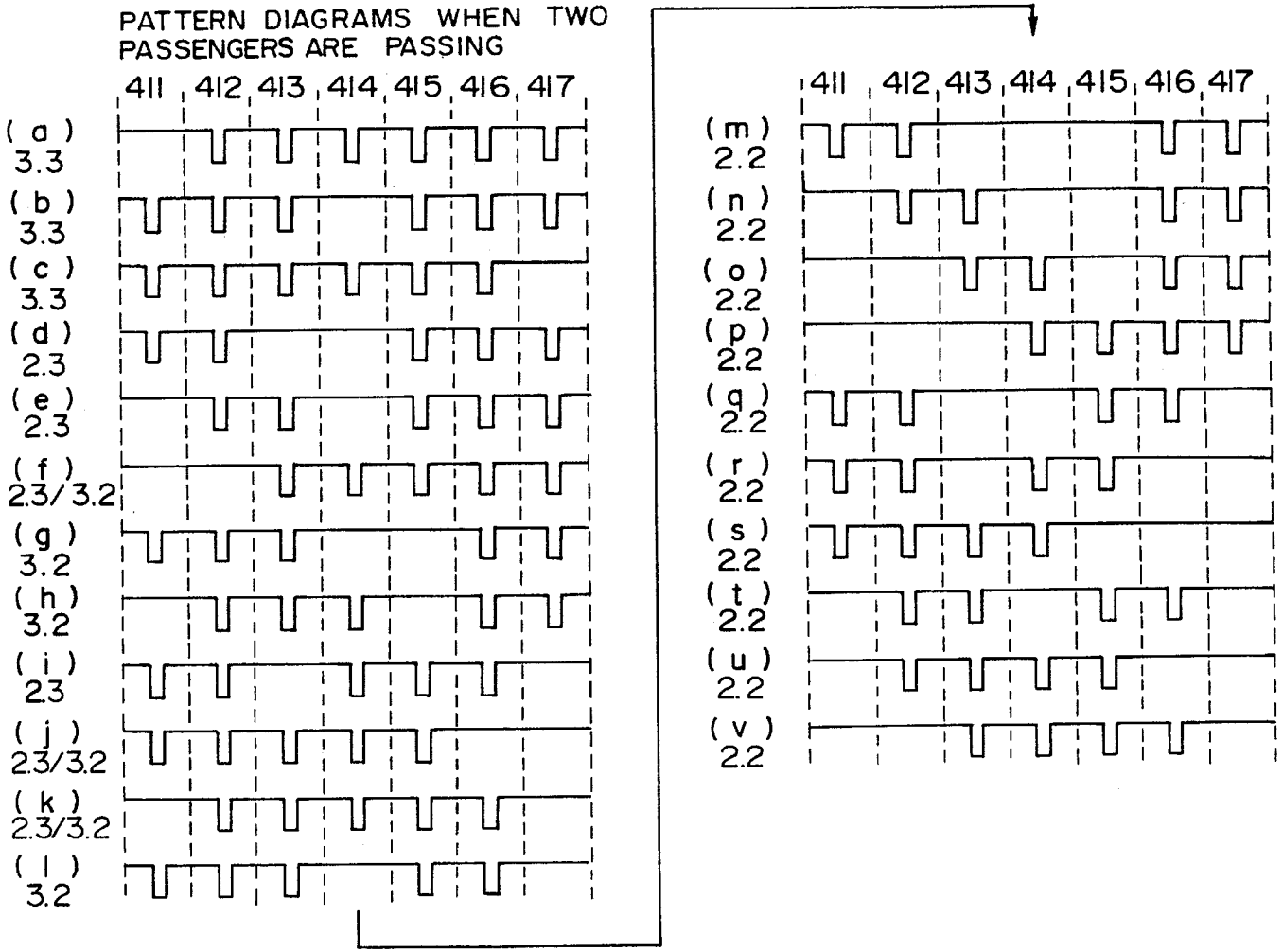
FIG. 8 is another increment value selection table for explaining the operation of the sensor/counter unit shown in FIGS. 6A and 6B.

FIGS. 6A and 6B show another configuration of the passenger sensor/counter unit according to the present invention. FIG. 6A is a front view showing a measuring place defined adjacent a wide doorway which allows two or more persons to pass therethrough in parallel. FIG. 6B is a top view of the measuring place shown in FIG. 6A. FIG. 7 and FIG. 8 show increment value selection tables for explaining how passengers are counted when passing through this measuring place. Specifically, FIG. 7 shows an increment value selection table for one person, and FIG. 8 shows in combination a similar table for two persons.

The passenger sensor/counter unit shown in FIGS. 6A and 6B is suitable for counting the number of passengers getting on and off a car through a doorway having a wide door which allows two persons to pass therethrough in parallel.

In FIGS. 6A and 6B, reference numeral 41 designates a differential type infrared sensor including infrared sensor elements 411–417 for sensing a temperature change caused by absorbing infrared rays emanated from a passenger passing through a passenger measuring place 47. Reference numeral 49 designates a unit for recognizing a sensing pattern indicating a temperature change in light receiving ranges 511–517 of the respective infrared sensor elements 411–417. Reference numerals 44, 46 designate a pair of photo sensors serving as a direction sensor for determining whether a passing passenger is getting on or off a car; and 48 an up/down counter for counting the number of passengers passing through the doorway.

The operation of the passenger sensor/counter unit shown in FIGS. 6A and 6B will be explained with reference to FIGS. 7 and 8.

The plurality of infrared sensor elements are linearly arranged in the direction orthogonal to the going direction of passing passengers above the passenger measuring place 47 such as a wide doorway which allows two persons to simultaneously pass therethrough. A spacing between adjacent ones of the plurality of infrared sensor elements is the same distance as the diameter 51 of the light receiving ranges of the respective sensor elements. Specifically, the spacing is set to approximately one third of the width of a physically normal person.

In the passenger sensor/counter unit of Figs. 6A and 6B, at a wide doorway with a frontage of 120 cm, through which two persons can pass in parallel, seven infrared sensor elements equally spaced by 17 cm are linearly arranged in a range of nine cm. The diameter 51 of respective light receiving range is chosen to be 17 cm so as to form a temperature change sensing band in a maximum width portion. Reference numeral 49 designates a sensing pattern recognition unit which analyzes a sensing pattern based on an input pattern formed of pulse signals from the seven infrared sensors for selecting an increment value representative of the number of passengers.

For the selection of an increment value, an increment value of passengers is set to +1 when one of patterns shown in (a)–(g) of FIG. 7 is detected, and to +2 when one of (a)–(h) of FIG. 7. The selected increment value of passengers is supplied to an input D of the up/down counter 48.

Two pairs of LEDs 43, 45 for emitting light and photo sensors 44, 46 for receiving the light are parallelly arranged on both sides of the doorway 47 at a height h across which passengers 42 pass through the doorway 47. A direction sensor composed of two pairs of LEDs and photo sensors, i.e., the door side set 43, 44 and the room side set 45, 46 equally spaced by the distance d, operates in the following manner. When a passenger 42 gets on a car through a doorway, the direction sensor set 43, 44 on the doorway side first senses the passenger 42, and the direction sensor set 45, 46 on the room side subsequently senses the passenger 42, to cause the sensors 44, 46 to generate pulse signals I, O each having a pulse width equal to a constant time t1. The pulse signals I, O from the sensors 44, 46 are supplied to input I, O of the up/down counter 48, respectively. If the pulse signal I is inputted to the up/down counter 48 prior to the pulse signal O, the counter determines that a direction signal indicates that a passenger has got on the car (IN), so that the counter 48 can count a passenger getting on the car. Conversely, if a passenger is getting off the car through the doorway, the pulse signals I, O are inputted to the counter 48 in the order reverse to the above, whereby the passenger getting off the car can be counted. Since the operation of the up/down counter 48 is substantially similar to that of the counter shown in FIGS. 4A–4C, explanation thereof will be omitted.

The increment value selection table of FIG. 7 shows patterns each formed of pulse signals from the seven infrared sensors arranged at the passenger measuring place 47 shown in FIGS. 6A and 6B, one of which is inputted to the sensing pattern recognition unit 49, when a passenger 42 is passing through the passenger measuring place 47. The 11 pulse signals (a)–(k) are temperature change sensing signal patterns, one of which is generated by the seven infrared sensor elements 411–417 when a passenger passes through the passenger measuring place 47. In the increment value selection table of FIG. 8, a temperature change sensing signal pattern generated by the seven infrared sensor elements 411–417 corresponds to two of pulse signal patterns (a)–(v) when two passengers 42 are simultaneously passing through the passenger measuring place 47 in FIGS. 6A and 6B. For example, if the number of passengers 42 passing through the passenger measuring place 47 is one, a temperature change caused by this passenger 42 may be sensed by two or three consecutive ones, covering the width of the passenger, of the infrared sensor elements 411–417, since the diameter 51 of the light receiving range of each infrared sensor element 41 is approximately one third of the width of a physically normal person. Thus, one of 11 patterns shown in FIG. 7 is generated. The sensing pattern recognition unit 49, upon receiving a pulse signal pattern equal to any of the 11 sensing patterns (a)–(k), matches the received pulse signal pattern with those in the increment value selection table of FIG. 7 to select "+1" as an increment value of passengers, and supplies the count value "+1" to the input D of the up/down counter 48.

On the other hand, if the received pulse signal coincides with any of 22 patterns in the increment value selection table of FIG. 8, a count value "+2" is supplied to the input D of the up/down counter 48.

In this manner, even if two persons can simultaneously pass through a wide doorway, the number of passengers getting on and off this doorway can be correctly counted by the passenger sensor/counter unit of this embodiment which is characterized by means including seven linearly arranged infrared sensor elements for sensing a temperature change in a light receiving range and generating a sensing pattern indicative of the temperature change; means for adding the number of simultaneously passing persons to a counted value based on the sensing pattern indicative of the temperature change generated by the respective infrared sensor elements; direction determination means including photo sensors forming pairs with the infrared sensor elements for determining whether a passenger is getting on or off a car; and means for accumulating the number of sensed passengers to the counted value in increasing or decreasing direction. This passenger sensor/counter unit can promptly and correctly count the number of passengers simultaneously getting on and off a car through a wide doorway and calculate the number of passengers in the car.

As is apparent from the foregoing description, this embodiment can realize correct counting of passengers getting on and off through a wide doorway such as those provided in cars of ordinary trains and buses, through which two persons can pass in parallel.

Figure 9:
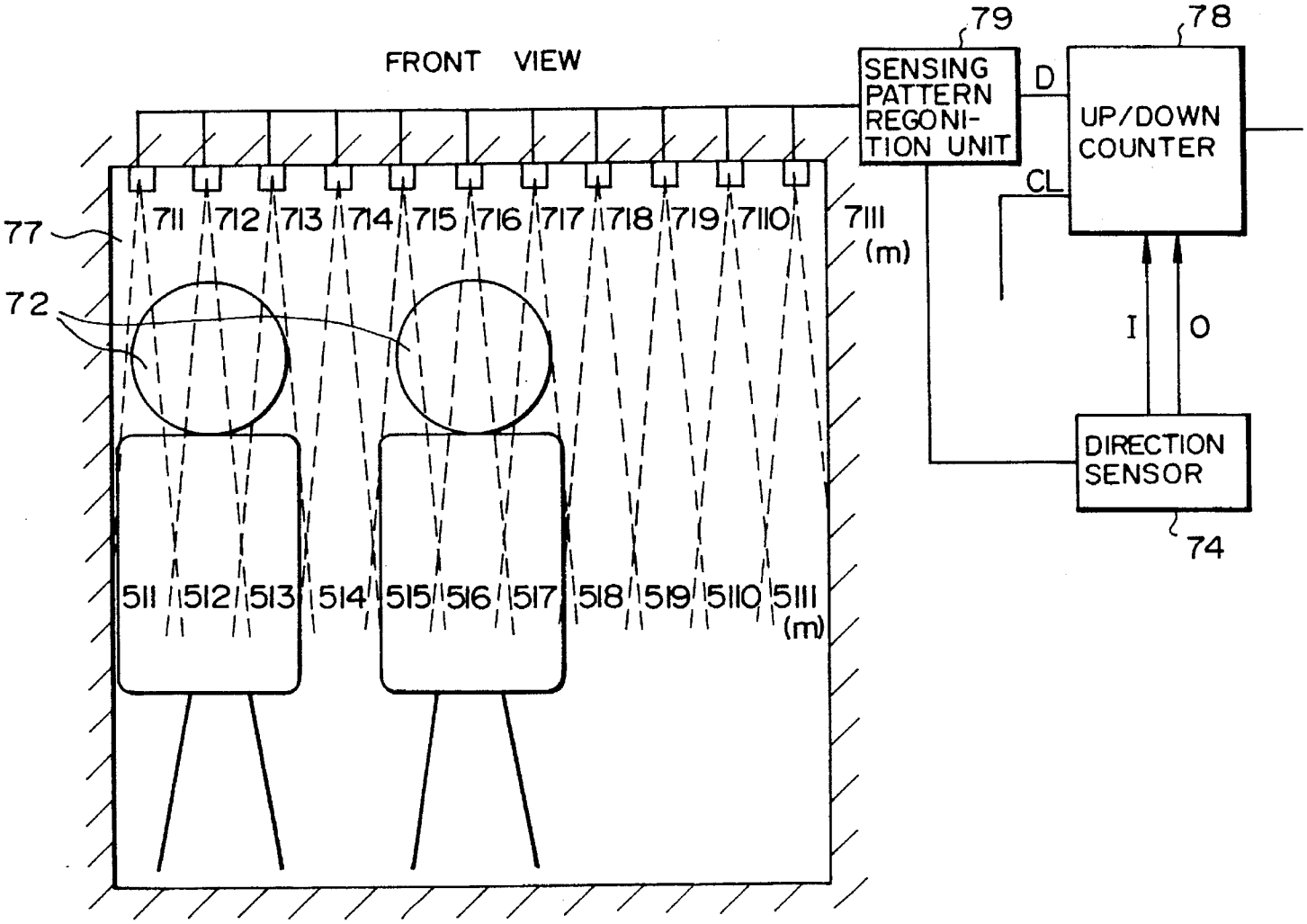
FIG. 9 is a front view showing a further example of the passenger sensor/counter unit in the management system of the present invention.
Figure 10:
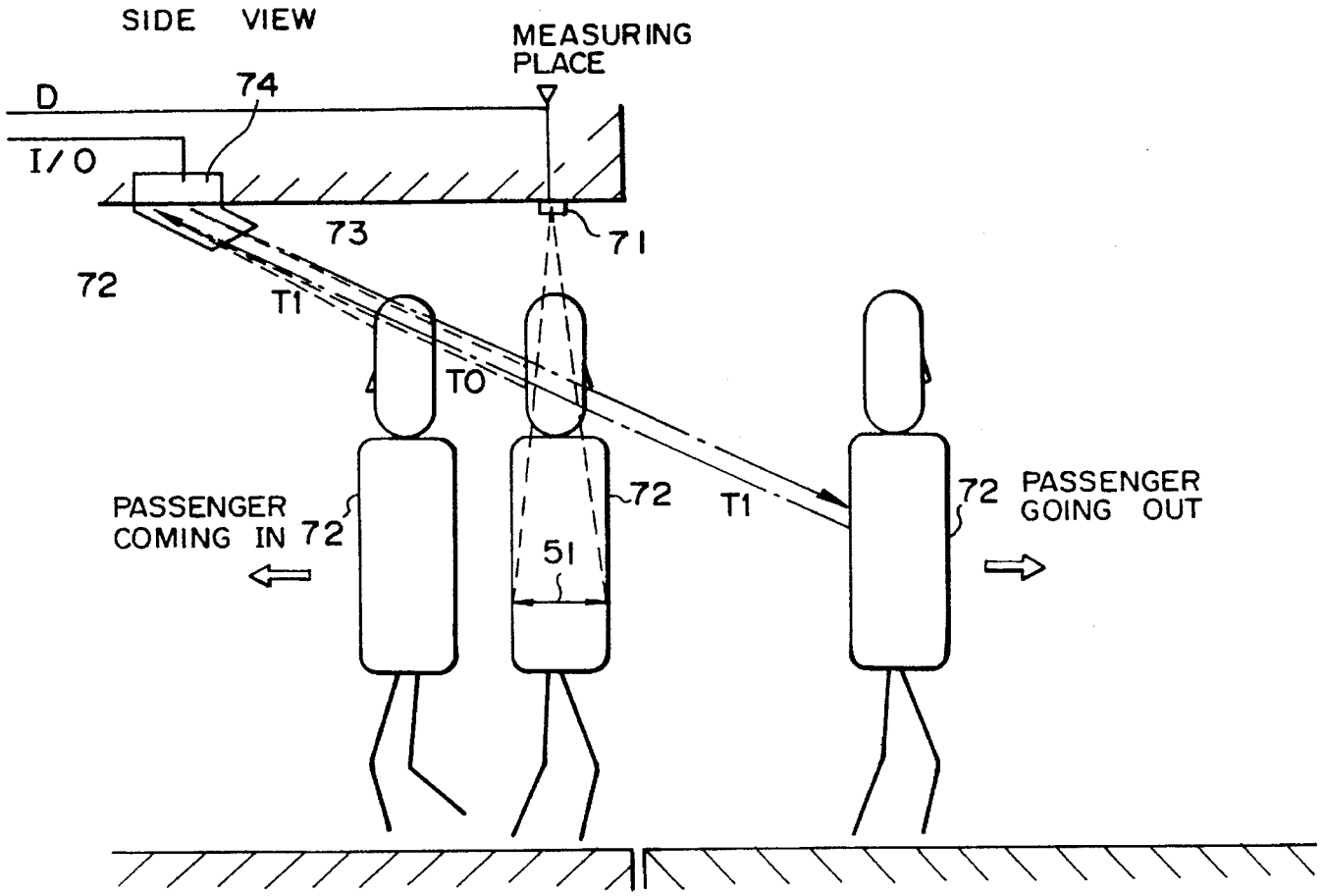
FIG. 10 is a side view of the passenger sensor/counter unit shown in FIG. 9.
Figure 11:
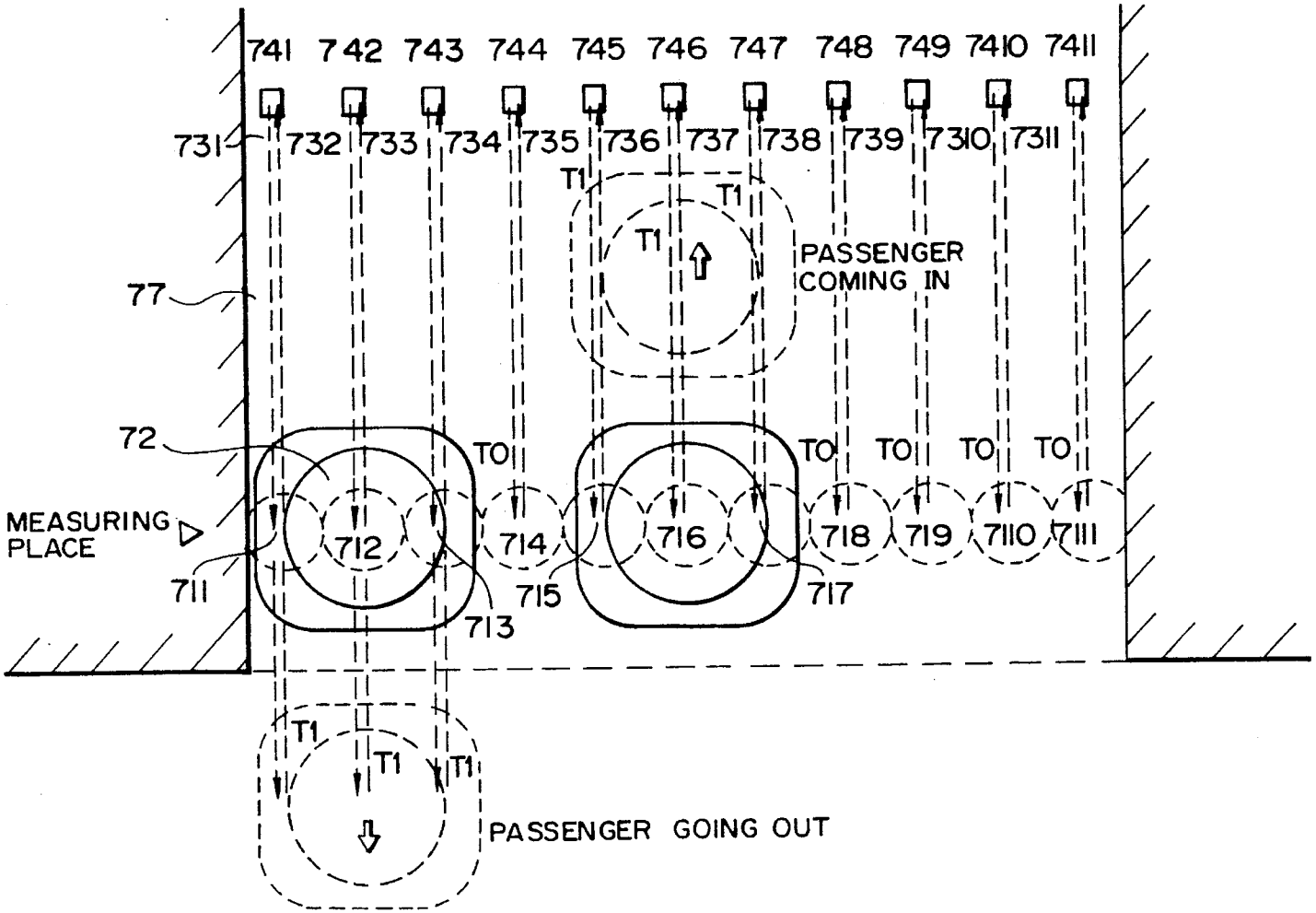
FIG. 11 is a top view of the passenger sensor/counter unit shown in FIG. 9.
Figure 12:
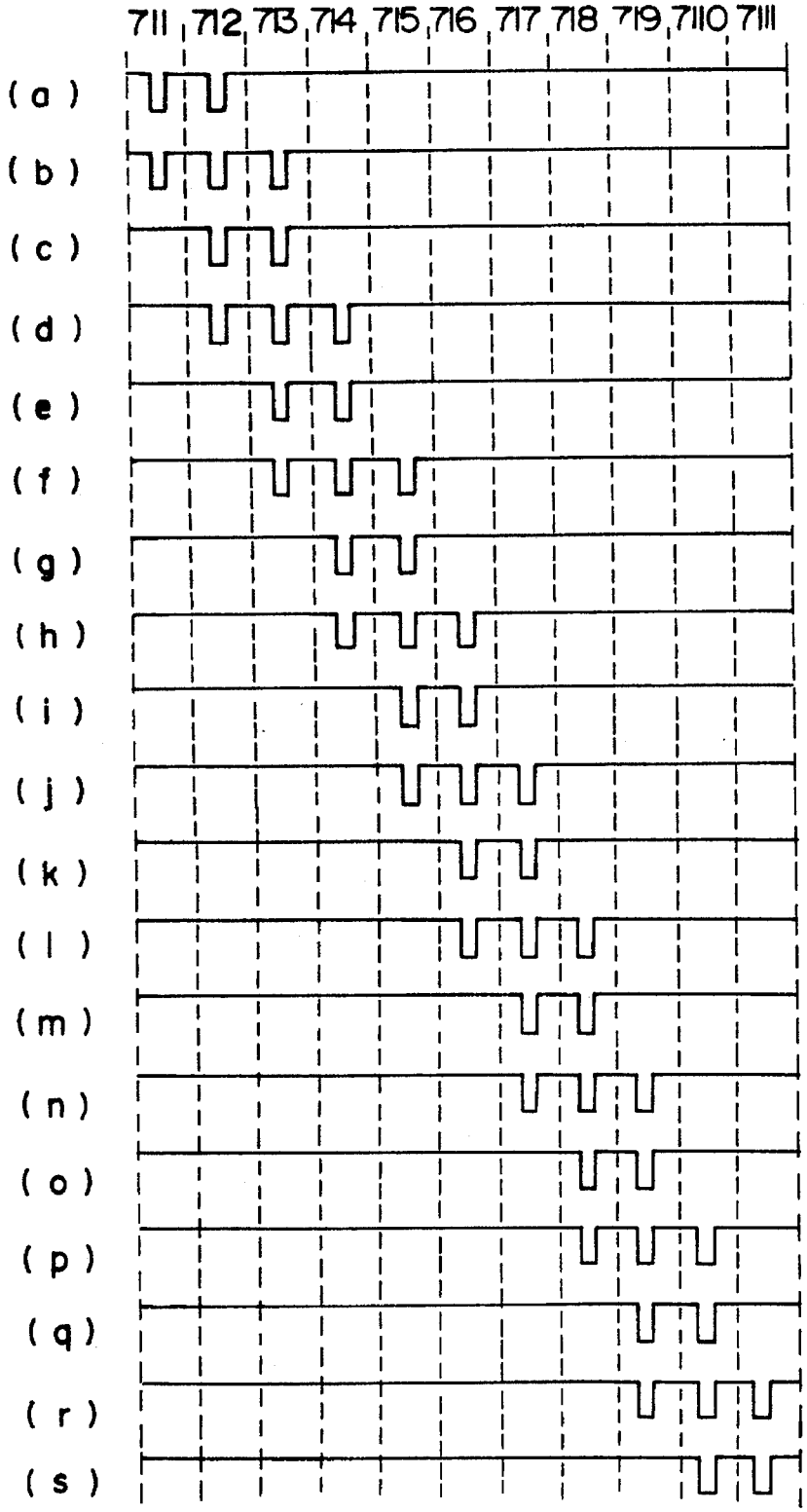
FIG. 12 is an increment value selection table for explaining the operation of the sensor/counter unit shown in FIG. 9.
Figure 13:
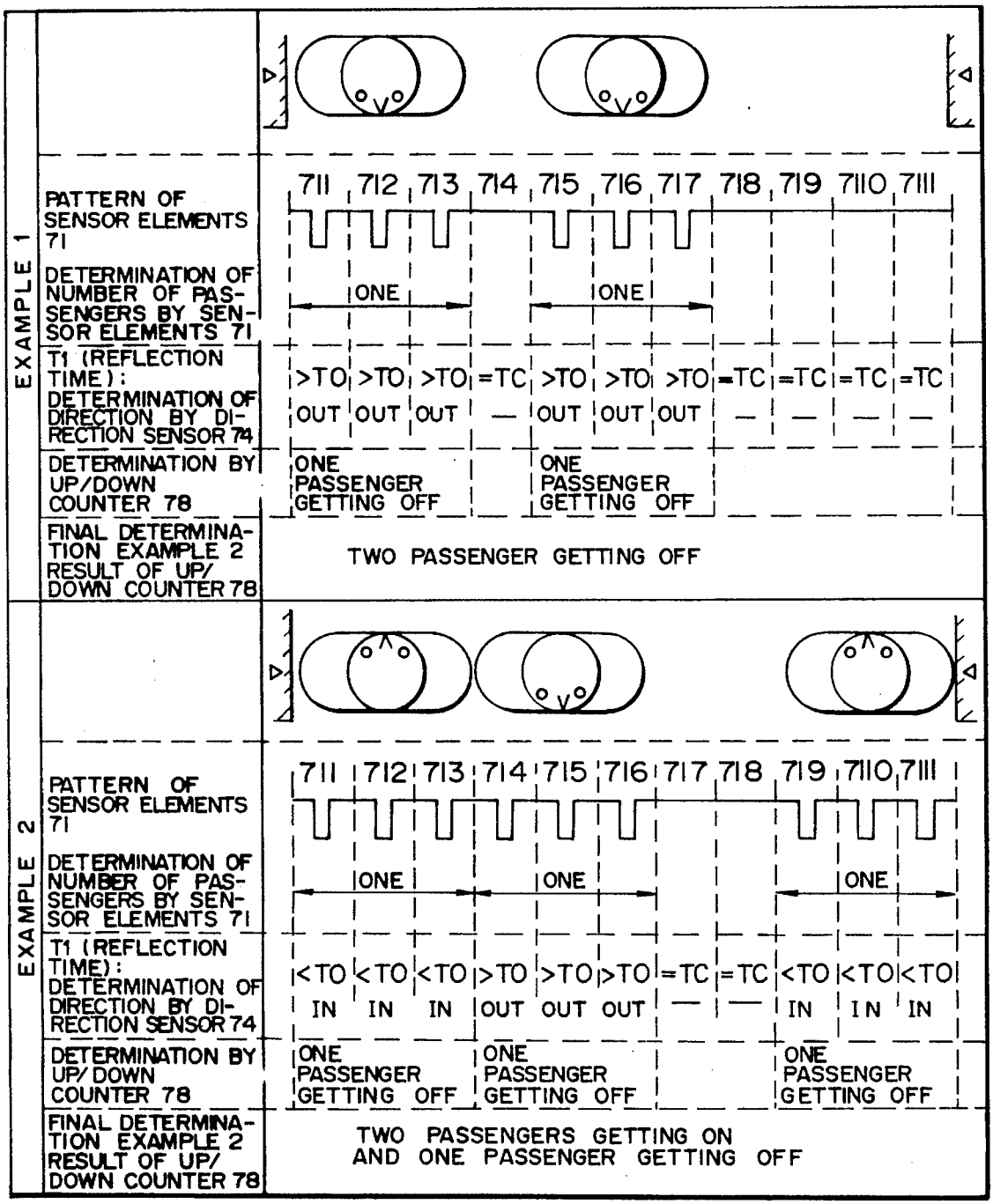
FIG. 13 is an explanatory diagram for explaining the operation of the sensor/counter unit shown in FIG. 9.

FIGS. 9–11 shows a further configuration of the passenger sensor/counter unit of the present invention. More specifically, FIG. 9 is a front view showing a measuring place adjacent a wider doorway of a car, through which three persons can get on or off in parallel; FIG. 10 is a side view of the measuring place of FIG. 9; and FIG. 11 is a top view of the measuring place of FIG. 9. Further, FIG. 12 shows an increment value selection table for explaining how passengers are counted at the measuring place, and FIG. 13 is an explanatory diagram for the operation of the passenger sensor/counter unit of FIG. 9.

The passenger sensor/counter unit shown in FIGS. 9–11 is suitable for counting the number of passengers getting on and off through a wider doorway such as that of an elevator, through which a plurality of physically normal persons can simultaneously come in and go out.

In FIG. 9, a passenger sensor 71 includes differential type infrared sensor elements 711–7111, each of which senses a temperature change caused by absorbing infrared rays emanated from passengers 72 passing through a passenger measuring place 77, and generates a pulse signal in response. Reference numeral 79 designates a sensing pattern recognition unit for recognizing a sensing pattern, generated by 4n∓infrared sensor elements, indicative of a temperature change in a light receiving range 81 of the infrared sensor 71; 74 a direction sensor composed of photo sensors forming pairs with the infrared sensor elements for determining whether a passenger is getting on or off a car; and 78 an up/down counter for counting the number of passengers passing through the measuring place.

The operation of the passenger sensor/counter unit will now be explained with reference to FIGS. 9–13.

4n∓infrared sensor elements 71 are linearly arranged in the direction orthogonal to the going direction of passengers above the passenger measuring place 77 defined adjacent a wide doorway through which n physically normal persons can simultaneously come in and go out in parallel. A spacing between the m infrared sensor elements 71 is set to the same length as the diameter 81 of the light receiving range, specifically, a value equal to approximately one third of the width of a physically normal person.

Assume that a maximum length of a frontage of the passenger measuring place 77 defined adjacent a wide doorway, through which n physically normal persons can simultaneously come in and go out, is set to 60×n cm. Above the passenger measuring place 77, m (=4n+3) infrared sensor elements 71 are linearly arranged at intervals of approximately 17 cm at such positions that both ends of the sensor element sequence are equally spaced from the respective walls. The diameter 81 of the light receiving range for each infrared sensor element is see to approximately 18 cm such that a temperature change sensing band is formed in a maximum width portion.

If the number of passengers 72 passing through the passenger measuring place 77 is one, a temperature change caused by this passenger 72 is sensed by two or three consecutive ones, covering the width of the passenger, of the infrared sensor elements 711, 712, . . . 71-m forming the infrared sensor 71, since the diameter 81 of the light receiving range of each infrared sensor element 71 is set to approximately one third of the width of a physically normal person. The number of sensing patterns for selecting an increment value "+1" representing one passenger passing through the measuring place, as the above case, is calculated as (2×(m−2)+1), i.e., 8n+3. Assume in the case of FIG. 9 that a frontage of a wide doorway is selected to be 180 cm, through which three persons can pass in parallel, 11 infrared sensor elements 71 are linearly arranged at intervals of approximately 17 cm with the leftmost and rightmost sensor elements placed at 5 cm from the respective ends, and the diameter of the light receiving range is selected to be 18 cm such that a temperature change sensing band is formed in a maximum width portion. Reference numeral 79 designates a sensing pattern recognition unit for analyzing a sensing pattern based on input patterns of pulse signals from the 11 infrared sensor elements 71 (711, 712, . . . , 7111) in order to select an increment value representative of the number of passing passengers.

When a sensing pattern coincides with one of patterns (a)–(s) in the increment value selection table shown in FIG. 12, the increment value of passengers is set to "+1". In this manner, a sensing pattern is selected from combinations of pulse signals generated by the 11 infrared sensor elements 71 (711, 712, . . . , 7111), and an increment value of passengers is supplied to an input D of the up/down counter 78. The increment value selection table of FIG. 12 is an explanatory diagram for showing patterns of pulse signals generated from the 11 infrared sensor elements 71 (711, 712, . . . , 7111) arranged in the passenger measuring place 77, one of which is inputted to the sensing pattern recognition unit 79, when the number of passengers 72 passing through the passenger measuring place 77 in FIG. 9 is one. 19 pulse signal patterns (a)–(s) are each formed of temperature change sensing signals generated by the 11 infrared sensor elements 71 (711, 712, . . . , 7111) when one passenger passes through the passenger measuring place 77, as described above.

On the other hand, if a plurality of passengers 72 simultaneously pass through the passenger measuring place 77, a temperature change pattern caused by each of these passengers 72 is similar to the foregoing case where the number of passengers passing through the passenger measuring place 77 is one. Therefore, if two passengers 72, for example, simultaneously pass, an input pattern composed of specific pulse signals generated by the 11 infrared sensor elements 71 (711, 712, . . . , 7111) arranged in the passenger measuring place 77 is a combination of two of the 19 patterns in the increment value selection table shown in FIG. 12. Then, the sensing pattern recognition unit 79, when receiving a pulse signal pattern composed of a combination of two patterns as described above, selects an increment value of passengers as "+2" which is supplied to the input D of the up/down counter 78.

Referring now to FIG. 10, reflection type photo sensors 74 (741, 742, . . . , 7411) equal in number to the infrared sensor elements and LEDs 73 (731, 732, . . . , 7311) arranged on the ceiling of the doorway 77 opposite to the photo sensors 74 (741, 742, . . . , 7411) for emitting ultra-high frequency waves are formed in pair to constitute direction determination means for determining whether a passenger 72 passing through the doorway 77 is coming in or going out. The ultra-high frequency waves from the LEDs 73 reflected by a passenger 72 passing through the measuring place 77 are received by the photo sensor 74. The direction sensor composed of the reflection type LEDs and the photo sensors, equal in number to the infrared sensor elements, determines from a change in reflection time caused by the passenger 72 whether the passenger 72 comes in or goes out. If the reflection time decreases, the passenger is determined to come in. Conversely, if the reflection time increases, the passenger is determined to go out. Pulse signals I, O generated from this determination result are supplied to inputs I, O of the up/down counter 78, respectively. The up/down counter 78 determines that a direction signal indicates IN if the pulse signal I is inputted, so that the number of passengers getting on can be counted. Conversely, if passengers are getting off the car through the doorway, the operation reverse to the above is performed, whereby the number of passengers getting off the car can be counted.

More specifically, when the differential type infrared sensor elements 71 (711, 712 . . . , 7111) sense a temperature change caused by absorbing infrared rays emanated from a passenger 72, when passing through the passenger measuring place 77, to generate pulse signals, a time T0 required for light rays emitted from the LEDs 73 to reach the direction sensors 74 is compared with a time T1 required for the light rays from the LEDs 73 to reach the direction sensors 74 a predetermined time after the time T0 has been measured, to determine the direction in which the passenger 72 is going. For example, when a passenger is getting on, T1 is shorter than T0, so that the direction sensors 74 generate the pulse signals I, O indicative of IN. Conversely, when a passenger is getting off, T1 is longer than T0, so that the direction sensors 74 generate the pulse signals I, O indicative of OUT. Incidentally, since no pulse signal is sensed when no passenger is passing through the passenger measuring place 77, the LEDs 73 will not basically emit light rays. Even if light rays were emitted, they would be reflected by the floor or the like. A reflection time in this event is a particular time TC which can be distinguished from T0.

Referring now to FIG. 13, the operation of the passenger sensor/counter unit of FIG. 9 will be explained for the case where the unit counts the number of passengers simultaneously getting on and off a car through a wide doorway. Example 1 shows that two passengers are simultaneously getting off a car, and Example 2 shows that two passengers are getting on a car while a passenger is simultaneously getting off the car. The number of passengers simultaneously passing through the passenger measuring place is added based on a sensing pattern generated by the 11 infrared sensor elements, and the photo sensors, equal in number to the infrared sensor elements, additionally determine the going direction of each passenger, whereby the number of passengers simultaneously passing through the measuring place in both directions can respectively be counted. The pulse signals I, O, indicative of the respective results are supplied to the inputs I, O of the up/down counter 78, respectively, to accumulate the number of passengers getting on the car and the number of passengers getting off the car.

More specifically, it can be seen in Example 1 that pulse signals forming a sensing pattern are generated by the infrared sensor elements 711, 712, 723, 715, 716, 717, and this particular pattern is a combination of the patterns (b) and (j) of FIG. 12. It is therefore determined that two passengers of normal constitution are passing through the measuring place. Also, the in/out direction of the respective passengers is determined as OUT by the direction sensor groups 741, 742, 743; and 745, 746, 747. Thus, the determination made from the results of the direction sensors indicates that two passengers are getting off the car. In Example 2, since pulse signals forming a sensing pattern are generated by the infrared sensor elements 711, 712, 713, 715, 716, 719, 7110, 7111, and this particular pattern is a combination of the patterns (b), (h) and (r) of FIG. 12, it is determined that three passengers of normal constitution are passing through the measuring place. The in/out direction of the respective passengers is determined as IN by direction sensor groups 741, 742, 743; and 749, 7410, 7411 and as OUT by a direction sensor group 744, 745, 746. Thus, the determination made from the results of the direction sensors indicates that two passengers are getting on and one passenger is getting off. It should be noted that the sensing pattern of Example 2 may be interpreted, though it is quite rare, as a combination of the patterns (a), (e), (i), (r) of FIG. 12, so that the number of passengers are determined to be three children and one person of normal constitution. However, a correct determination result may be obtained from the in/out direction determination and experience.

As is apparent from the foregoing, the passenger sensor/counter unit can be realized for detecting the number of passengers getting on and off a car through a wide doorway which allows n passengers of normal constitution to simultaneously pass therethrough. The unit comprises means including linearly arranged (4n+3) temperature sensors for sensing a temperature change in a light receiving range; means for adding the number of simultaneously passing passengers based on a sensing pattern indicative of the temperature change generated by the respective temperature sensors; direction determination means including photo sensors equal in number to the temperature sensors, the photo sensors forming pairs with the temperature sensors, for determining the direction in which a passenger is going; and means for accumulatively counting an increment value indicative of the number of passengers simultaneously getting on a car and a decrement value indicative of the number of passengers simultaneously getting off the car. This unit, capable of counting the number of passengers getting on and off a car as well as the number of passengers in the car, is appropriate to promptly and correctly detect the number of passengers simultaneously getting on and off a car through a wide doorway.

It should be noted that this unit is not limited to count the number of passengers getting on and off a car, but may also be used widely for counting the number of persons passing through a general measuring place such as a wide entrance of a theater, an exhibition hall, or the like, where a plurality of spectators may go in and out in parallel.

As is clearly understood from the foregoing embodiment, data on the number of passengers, such as the number of passengers in each car of a train, the number of passengers getting on and off a car through each doorway, and so on, are collected and transmitted to receivers provided in forward stations or the like by a transmission unit arranged in the train. The data received by the receiver in each station is processed by a communication circuit and stored in a storage unit in the form of files, under control of a data controller. The data may be clearly broadcasted by a speech broadcasting and passenger guiding unit or printed by a printer.

The speech broadcasting and passenger guiding unit, which is controlled by the data controller, may be incorporated in a broadcasting system which utilizes a synthetic voice generator to provide automatic guiding for passengers.

With the riding situation guiding management system realized by the present invention, the speech broadcasting and passenger guiding unit broadcasts a riding ratio and a crowdedness degree for each of the cars constituting a train, so that passengers can stand in a queue for a car, which is informed to have vacant seats, waiting for a train to arrive. If passengers are informed than no vacant seat is available in a next train, but many vacant seats are found in the next but one train, passengers having enough time can determine that they will take the next but one train, which is not so crowded, in order to comfortably go seated to their destination if this merely results in a slight delay. Stated another way, the riding situation guiding management system of the present invention can lead passengers to not so crowed cars such that cars of a train are substantially uniformly filled with passengers, thus improving a passenger transportation efficiency.

Also, as is apparent from the foregoing embodiment, the present invention can lead waiting passengers to recognize a current version of desired riding information in advance, similarly to the first embodiment, as well as visually provide such information on the screen of a display unit in order for passengers to visually and readily confirm their determination on selection of a car when they are impatient before getting on a car, thus producing larger effects for passengers' services.

Further, the desired riding information may be printed by a printer to distribute the printed information to passengers.

As is also apparent from the foregoing embodiments, the present invention provides passengers with guiding services in order to have a comfortable trip, avoid concentration of passengers in a particular car, ensure safe getting on and off of passengers, reduce time required for getting on and off a train, and so on.

A storage unit may be used to accumulate a large amount of data such as the number of passengers and the riding ratio in each car of each train at each hour on each day or each day of the week, the number of passengers getting on and off in each station, and so on. These data may be analyzed and utilized at maximum, when creating or revising a train diagram, to plan assignment of trains and time setting in consideration of the relieving of extremely crowded trains and economical efficiency. The riding situation guiding management system realized by the present invention can therefore collect a much larger amount of data and accumulate highly accurate data which may be analyzed from any factor, as compared with the conventional traffic investigation which requires a large number of persons and is performed in human sea tactics manner. Further, in comparison with a conventional collection of data for traffic investigation, which relies on manual operations, data collection by means of a storage unit requires less cost, time, and personnel, so that the conventional manually operated traffic survey can be rendered unnecessary.

As is apparent from the foregoing embodiments, the present invention can realize correct counting of passengers getting on and off a car through a narrow doorway such as that of the train of the Shinkansen which does not allow two or more passengers to pass therethrough in parallel.

As is also apparent from the foregoing embodiments, a passenger sensor/counter unit is realized for detecting the number of passengers coming in and going out through a wide doorway which allows two persons to pass therethrough in parallel. The unit comprises means including linearly arranged infrared sensor elements for sensing a temperature change in a light receiving range and generating a sensing pattern indicative of the temperature change; means for determining the number of simultaneously passing passengers from the sensing pattern indicative of the temperature change, generated by the infrared sensor elements; means including two photo sensors for determining whether a passenger is coming in or going out; and means for accumulatively counting increment and decrement values, each indicative of the number of simultaneously passing passengers. This passenger sensor/counter unit can efficiently and accurately reveal the number of passengers existing in a car at the time the number of passengers getting on and off the car is being counted.

As is apparent from the foregoing embodiments, the present invention realizes the passenger sensor/counter unit for detecting the number of passengers coming in and going out through a wide doorway which allows n passengers of normal constitution to simultaneously pass therethrough. The unit comprises means including linearly arranged (4n+3) temperature sensors for sensing a temperature change in a light receiving range; means for determining the number of simultaneously passing passengers based on a sensing pattern indicative of the temperature change generated by the respective temperature sensors; direction determination means including the same number of photo sensors as the temperature sensors, the photo sensors forming pairs with the temperature sensors, for determining the direction in which a passenger is going; and means for accumulatively counting increment values and decrement values. This passenger sensor/counter unit, which counts the number of passengers getting on and off a car as well as the number of passengers in the car, is capable of promptly and correctly detecting the number of passengers simultaneously getting on and off the car through a wide doorway as well as the number of passengers existing in the car at that time.

It will be understood that this passenger sensor/counter unit is not limited to count the number of passengers getting on and off a car, but may also be used for counting the number of persons passing through a general measuring place such as a wide entrance of a theater, an exhibition hall, or the like, where a plurality of spectators or visitors may come in and go out in parallel.

I claim:

1. A situation guiding management system comprising:

a plurality of counting means for counting a number of persons entering and a number of persons exiting each of a plurality of enclosed areas, said plurality of counting means including a plurality of temperature sensors linearly arranged for sensing a temperature change, in respective portions of said enclosed areas, sensing pattern recognition means for determining, responsive to outputs of said temperature sensors, a number of persons entering and exiting each of the enclosed areas, photosensors for determining whether said persons entering and exiting said each of said plurality of enclosed areas are entering or exiting, an up/down counter connected to the pattern recognition means and the photosensors for accumulatively counting up and down the number of persons entering and exiting each of the plurality of enclosed areas to generate a count, and a plurality of light emitting diodes for emitting light into respective ones of said portions of said enclosed areas so that when one of the plurality of persons is in one of the areas, said one of the plurality of persons reflects said light from a respective one of the plurality of light emitting diodes to a respective one of the photosensors;

transmission means for receiving the count from the plurality of counting means and transmitting the count to at least one waiting area; and broadcasting means, arranged in the at least one waiting area, for receiving the count and analyzing the count from the transmission means, to broadcast information indicating a current crowding situation in each of the plurality of enclosed areas.

2. A situation guiding management system according to claim 1, wherein said broadcasting means comprises:

display means for displaying at least part of said information; and printing means for printing said at least part of said information.

3. A situation guiding management system according to claim 2, wherein said broadcasting means further comprises:

input means for receiving an input from one of said persons in said at least one waiting area; and control means for controlling said printing means to print a portion of said information in accordance with said input.

4. A situation guiding management system according to claim 1, wherein:

said plurality of counting means comprise recording means for recording said count; and said broadcasting means comprises:

storage means for accumulatively storing said count; and analyzing means for statistically analyzing said count accumulatively stored in said storage means.

5. A situation guiding management system according to claim 1, wherein said broadcasting means comprises means for synthesizing speech in accordance with said information and broadcasting said speech.

6. A situation guiding management system according to claim 1, wherein:

said plurality of enclosed areas are a plurality of cars of a train, each of said plurality of cars having at least one doorway and at least one passageway to an adjacent one of said plurality of cars;

said plurality of counting means comprise means for counting a number of persons entering and exiting said each of said plurality of cars through said at least one doorway and said at least one passageway; and said at least one waiting area is located in at least one station served by said train.

7. A situation guiding management system according to claim 1, wherein said information comprises guiding information for enabling persons to select a desirable one of said plurality of enclosed spaces.

8. A situation guiding management system comprising:

a plurality of counting means, arranged at each doorway of a plurality of enclosed areas, for counting a number of persons entering and a number of persons exiting each of said plurality of enclosed areas through said each doorway to generate a count;

transmission means for receiving said count from said plurality of counting means and transmitting said count from said plurality of counting means to at least one waiting area; and broadcasting means, arranged in said at least one waiting area, for receiving said count transmitted from said transmitting means and analyzing said count from said transmission means, to broadcast information indicating a current crowding situation in said each of said plurality of enclosed areas for persons waiting in the at least one waiting area;

wherein said plurality of counting means include, in said each of said plurality of enclosed areas:

a plurality of temperature sensors linearly arranged for sensing a temperature change in respective portions of said enclosed areas in order to produce a sensor output indicating a number of persons entering and exiting said each of said plurality of enclosed areas through its doorway which has a width to allow a plurality of persons of normal constitution to simultaneously pass therethrough;

sensing pattern recognition means for receiving said sensor output and recognizing in said sensor output a sensing pattern indicative of a temperature change sensed by said temperature sensors to determine the number of persons entering and exiting said each of said plurality of enclosed areas through its doorway;

photo sensors equal in number to said temperature sensors, respectively arranged adjacent each said doorway of said enclosed areas, for determining whether said persons entering and exiting said each of said plurality of enclosed areas are entering or exiting, said photo sensors forming pairs with said temperature sensors; and an up/down counter connected to said pattern recognition means and said photo sensors for accumulatively counting up and down the number of persons entering and exiting said each of said plurality of enclosed areas; wherein:

said doorway forms a single continuous aperture which allows said plurality of persons to simultaneously pass through said doorway; and said plurality of counting means further comprise a plurality of light emitting diodes, equal in number to said photo sensors, for emitting light into respective ones of said portions of said areas so that when one of said plurality of persons is in one of said portions of said areas, said one of said plurality of persons reflects said light from a respective one of said plurality of light emitting diodes to a respective one of said photo sensors.

9. A situation guiding management system according to claim 8, wherein said broadcasting means further comprises:

display means for displaying at least part of said information; and printing means for printing said at least part of said information.

10. A situation guiding management system according to claim 9, wherein said broadcasting means further comprises:

input means for receiving an input from one of said persons in said at least one waiting area; and control means for controlling said printing means to print a portion of said information in accordance with said input.

11. A situation guiding management system according to claim 8, wherein:

said plurality of counting means comprise recording means for recording said count; and said broadcasting means comprises:

storage means for accumulatively storing said count; and analyzing means for statistically analyzing said count accumulatively stored in said storage means.

12. A situation guiding management system according to claim 8, wherein said broadcasting means comprises means for synthesizing speech in accordance with said information and broadcasting said speech.

13. A situation guiding management system according to claim 8, wherein:

said plurality of enclosed areas are a plurality of cars of a train, each of said plurality of cars having at least one doorway and at least one passageway to an adjacent one of said plurality of cars;

said plurality of counting means comprise means for counting a number of persons entering and exiting said each of said plurality of cars through said at least one doorway and said at least one passageway; and said at least one waiting area is located in at least one station served by said train.

14. A situation guiding management system according to claim 8, wherein said at least part of said information comprises guiding information for enabling persons to select a desirable one of said plurality of enclosed spaces.

* * * * *